US010980348B2

(12) United States Patent
Policicchio

(10) Patent No.: US 10,980,348 B2
(45) Date of Patent: Apr. 20, 2021

(54) SEATING APPARATUS ASSEMBLED FROM COMPONENTS

(71) Applicant: Max Home, LLC, Fulton, MS (US)

(72) Inventor: Bruno Policicchio, Tupelo, MS (US)

(73) Assignee: Max Home, LLC, Fulton, MS (US)

( * ) Notice: Subject to any disclaimer, the term of this patent is extended or adjusted under 35 U.S.C. 154(b) by 0 days.

(21) Appl. No.: 16/583,798

(22) Filed: Sep. 26, 2019

(65) Prior Publication Data

US 2020/0100592 A1 Apr. 2, 2020

Related U.S. Application Data

(60) Provisional application No. 62/739,621, filed on Oct. 1, 2018, provisional application No. 62/743,957, filed on Oct. 10, 2018.

(51) Int. Cl.

| | |
|---|---|
| ***A47C 4/02*** | (2006.01) |
| ***A47C 17/02*** | (2006.01) |
| *A47C 4/03* | (2006.01) |
| *A47C 13/00* | (2006.01) |

(52) U.S. Cl.

CPC ..... *A47C 4/028* (2013.01); *A47C 17/02* (2013.01); *A47C 4/02* (2013.01); *A47C 4/03* (2013.01); *A47C 13/005* (2013.01)

(58) Field of Classification Search

CPC .. A47C 4/02; A47C 4/028; A47C 4/03; A47C 17/02; A47C 13/005

See application file for complete search history.

(56) References Cited

U.S. PATENT DOCUMENTS

| | | | | |
|---|---|---|---|---|
| 5,080,438 A * | 1/1992 | Moyer | A47C 4/028 297/440.23 |
| 2018/0142717 A1* | 5/2018 | Ejdemo | A47C 4/028 |
| 2020/0029699 A1* | 1/2020 | Brandtner | A47C 17/86 |

* cited by examiner

*Primary Examiner* — Syed A Islam

(74) *Attorney, Agent, or Firm* — Baker Donelson; Carl M. Davis, II

(57) ABSTRACT

A seating apparatus assembled from Furniture components readily shippable by common carrier comprising a base frame, a pair of side arm assemblies that align with opposing distal ends of the base frame, and a back assembly to assemble as a seating apparatus, with legs having threaded fasteners that extend through the base frame for engaging the side arm assemblies and supporting the seating apparatus on a floor. Connector members on the back assembly engage respective connector brackets on the side arm assemblies to secure the back to the seating apparatus. The base frame includes a stretcher with a support leg, which stretcher rotates to move the support leg from a shipping position to a supporting position in contact with the floor for use of the seating apparatus.

21 Claims, 4 Drawing Sheets

SEATING APPARATUS ASSEMBLED FROM COMPONENTS

The present application claims benefit of U.S. Provisional Patent Application Ser. 62/739,621, filed Oct. 1, 2018 and U.S. Provisional Patent Application Ser. No. 62/743,957 filed Oct. 10, 2018.

TECHNICAL FIELD

The present invention relates to furniture pieces for seating. More particularly, the present invention relates to furniture seating apparatus readily assembled on site from components that transport in packaging in accordance with common carrier size and weight shipping restrictions.

BACKGROUND OF THE INVENTION

In recent years, online commerce for sales of a wide range of goods and services has increased significantly. Consumers search web sites offering retail store services selling house hold goods, clothing, food, cleaning supplies, repair parts and enable consumers to specify and price major purchases such as vehicles. Industries have developed around the merchandising of goods and related industry of delivery of such goods to consumers. Common delivery carriers have received increased business handling the increased number of packages containing on-line purchased products.

Delivery companies have encouraged such commerce by providing rapid deliveries including overnight delivery, central pick-up locations, and brick-and-mortar delivery of in-store goods and products ordered and delivered to such stores.

Bulkier products such as furniture pieces, mattresses, and other large articles, are not readily handled by common delivery carriers, but on-line shopping web sites provides information and purchase opportunities. Bulky items are more difficult for common carrier delivery due to size and weight restrictions. Common delivery carriers typically have delivery vehicles with single driver/delivery servicer, and there are restrictions on the maximum weight such deliver servicer may be expected to lift and move during on-site delivery such as to an office or front door of a residence. Similarly, there are restrictions on length, width and depth as well as total overall combined measurements.

Accordingly, there is a need in the art for providing furniture seating that readily assembles from components that may ship to an end user in packaging that meets common carrier size and weight shipping requirements. It is to such that the present invention is directed.

SUMMARY OF THE INVENTION

The present invention meets the need in the art by providing a seating apparatus readily shipped as components in packaging that meets common carrier size and weight shipping requirements, which components have structural features that facilitate readily assembling. More particularly, the present invention provides a component seating assembly comprising a base frame having a pair of opposing spaced-apart longitudinal rails and a pair of opposing transverse members attached at respective ends in spaced-apart relation to the pair of rails. At least one elongated stretcher extends between the pair of rails intermediate the transverse members and a first leg extends from the stretcher medial the opposing ends of the stretcher, wherein the stretcher rotates about a longitudinal axis from a first position to a second position, the first position disposing the first leg in a plane defined by the base frame for shipping and the second position disposing the first leg extending normally for supportingly contacting a surface for use of the seating apparatus. A pair of side arm assemblies attaches to the base frame. Each side arm assembly has a first connector attached to a back upright of the side arm assembly and a pair of threaded seats in spaced relation in a bottom support of the side arm assembly. A back assembly has a pair of second connectors spaced-apart for mating engagement with the first connectors of the pair of side arm assemblies for connecting the back assembly to the side arm assemblies. A plurality of second legs each having a threaded member extending longitudinally for extending thorough a respective opening in the transverse member of the base frame and threadingly engaging a respective seat in a respective one of the side arm assemblies for securing the side arm assembly to the base frame.

In another aspect, the present invention provides a method of assembling a seating apparatus from components packaged for common carrier delivery, comprising the steps of:

(a) positioning a side arm assembly in alignment with a base frame, the side assembly having a first connector attached to a back upright of the side arm assembly and a pair of threaded seats in spaced relation in a bottom support of the side arm assembly, the base frame having a pair of opposing spaced-apart longitudinal rails and a pair of opposing transverse members attached at respective ends in spaced-apart relation to the pair of rails, the opposing transverse members each defining a pair of spaced openings for alignment with the threaded seats in a respective side arm assembly and at least one elongated stretcher extending between the pair of rails intermediate the transverse members;

(b) securing the side arm assembly to the base frame with a respective second leg having a threaded member extending longitudinally therefrom for extending thorough a respective opening in the transverse member of the base frame and threadingly engaging a respective seat in a respective one of the side arm assemblies;

(c) repeating steps (a) and (b) for a second side arm assembly on an opposing end of the base frame; and (d) positioning a back assembly in secured relation to the side arm assemblies, the back assembly having a pair of second connectors spaced-apart for mating engagement with the first connectors of the pair of side arm assemblies.

In another aspect, the present invention provides a seating apparatus comprising a base frame having a pair of opposing spaced-apart longitudinal rails and a pair of opposing transverse members attached at respective ends in spaced-apart relation to the pair of rails. At least one elongated stretcher extends between the pair of rails intermediate the transverse members and at least one first leg extends from the stretcher, wherein the stretcher rotates about a longitudinal axis from a first position to a second position, the first position disposing the at least one first leg in a plane defined by the base frame for shipping and the second position disposing the at least one first leg extending normally for supportingly contacting a surface for use of the seating apparatus. A pair of side arm assemblies each for connecting to the base frame at a respective one of the opposing ends and a back assembly for connecting to the side arm assemblies. A plurality of second legs each for depending from the base frame for supportingly contacting a surface for use of the seating apparatus.

In yet another aspect, the present invention provides a method of assembling a seating apparatus from components packaged for common carrier delivery, comprising the steps of:

(a) securing a first side arm assembly of a pair of side arm assemblies in alignment with a base frame, the base frame having a pair of opposing spaced-apart longitudinal rails and a pair of opposing transverse members attached at respective ends in spaced-apart relation to the pair of rails, and at least one elongated stretcher extending between the pair of rails intermediate the transverse members;

(b) securing a second side arm assembly of the pair of side arm assemblies to an opposing end of the base frame;

(c) positioning a first leg extending from the stretcher to supportingly contact a surface for use of the seating apparatus;

(d) securing a back assembly to the side arm assemblies; and (e) attaching a plurality of second legs to the base frame for supporting the seating apparatus on the surface.

Objects, advantages, and features of the present invention will become apparent upon a reading of the following detailed description in reference to the drawings and the appended claims.

DETAILED DESCRIPTION

Figure 1:
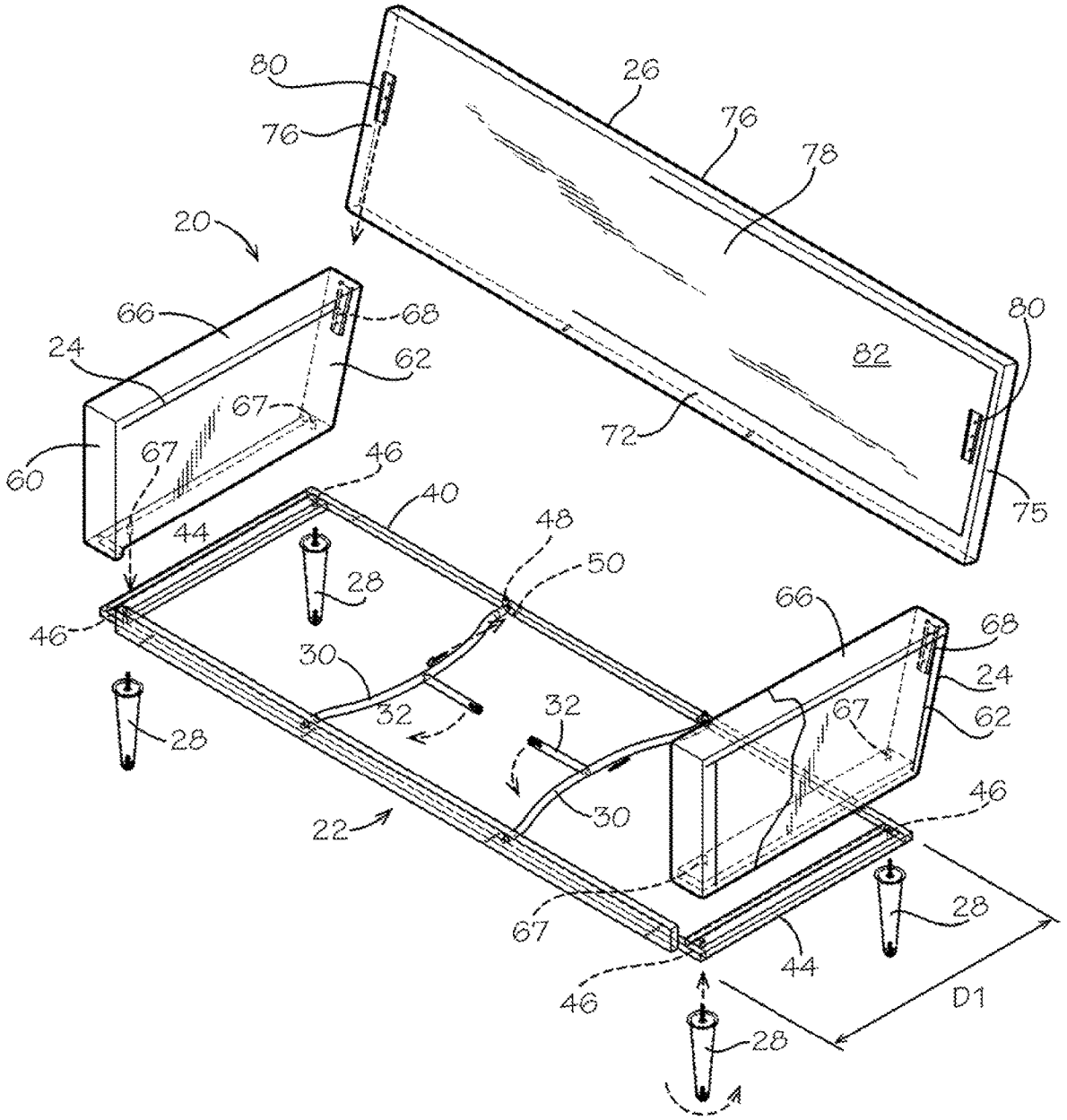
FIG. 1 illustrates in exploded perspective view a seating apparatus that assembles with components in accordance with the present invention.

With reference to the drawings in which like parts have like reference numerals, the present invention provides a seating apparatus of furniture components readily shippable by common carrier in packaging that meets size and weight restrictions. The furniture components have structural features that during assembly connect the furniture components together to assemble a seating apparatus such a chairs, sofa, love seats, chaises and other. The furniture components for the seating apparatus comprise a base frame, a pair of side arm assemblies, and a back assembly, with a plurality of legs for supporting the assembled seating apparatus on a floor. The legs have longitudinally extending screws that pass through a respective opening in the base frame and securely engage aligned nuts mounted in a rail of a respective side arm assembly, to secure the side arm assembly to the base frame. A connector bracket attaches to a back post of each of the side arm assemblies, which connector bracket engages a respective one of a pair of mating connector members that attach in spaced relation to the back assembly.

In an alternate embodiment, such as for an elongated sofa seating assembly, a stretcher mounts in the base frame intermediate opposing ends of the base frame and a support leg extends from the stretcher. The stretcher connects at opposing ends to rails of the base frame with the support leg extending downwardly for contacting a floor surface for supporting an intermediate portion of the seating assembly.

In an alternate embodiment, the stretcher rotatably mounts to the rails, for rotating about a longitudinal axis. The stretcher rotates from a shipping position (a first position) to an operational position (a second position) with the support leg extending downwardly for seating support. The opposing ends of the stretcher may secure to the rails of the base frame.

The support leg may extend longitudinally between a retracted position and an extended position for positioning the support leg in contact with a floor. Further, the support leg may extend to a selected length extending downwardly between the base frame and the floor for supporting the seating assembly. An embodiment uses telescopically received tubes while another embodiment uses a threaded nut that receives a threaded rod attached to a foot for selectively extending the leg from the base frame to the floor.

In a disclosed embodiment, the stretcher mounts to the rails of the base frame for shipping. The stretcher mounts in a first position that disposes the support leg in a plane defined by the base frame. The stretcher during assembly rotates about a longitudinal axis to move the support leg to a second position normal to the base frame for bearing support on the floor surface.

With continued reference to the drawings, FIG. 1 illustrates in exploded perspective view a seating apparatus 20 that assembles with separate components that are readily shipped in packaging that meets common carrier size and weight shipping requirements in accordance with the present invention. The seating apparatus 20 includes a base frame 22 to which a pair of side arm assemblies 24 attach. A back assembly 26 attaches to the pair of side arm assemblies. A plurality of legs 28 engage the side arm assemblies 24 to support the seating apparatus on a floor surface. The seating apparatus may include at least one stretcher 30 that connects in the base frame 22. A support leg 32 extends from the stretcher 30 for supporting an intermediate portion of the seating apparatus.

Figure 4:
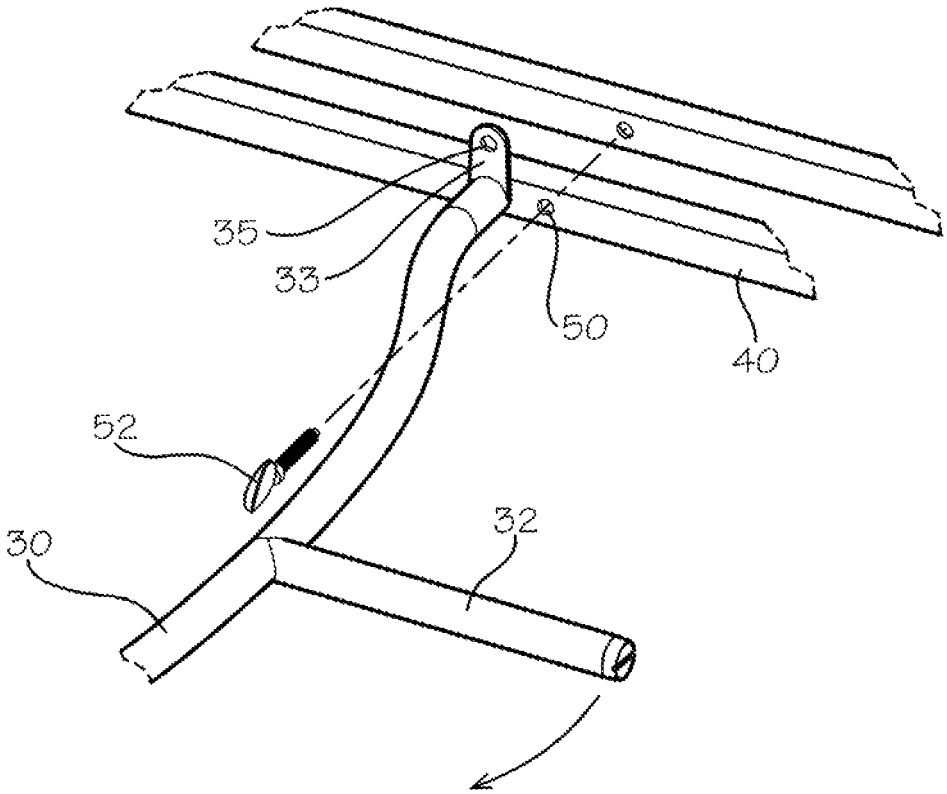
FIG. 4 illustrates a detailed view of a rail of the base frame to which an end of the stretcher secures to fix the stretcher in the second position.

As best illustrated in FIG. 4, a pair of plates 33 attach to the stretcher 30 with each plate near a respective distal end of the stretcher. The plates 33 define openings 35. The seating apparatus 20 in the illustrated embodiment is elongated for a sofa and includes two stretchers 30 each with a support leg 32. The support leg 32 may be integral with the stretcher 30 or alternatively attach with a threaded member. Alternatively, the support leg comprises a first tube that slidably telescopically receives a second tube for selectively positioning the leg relative to the floor and secured in the selected length with a fastener.

Figure 2:
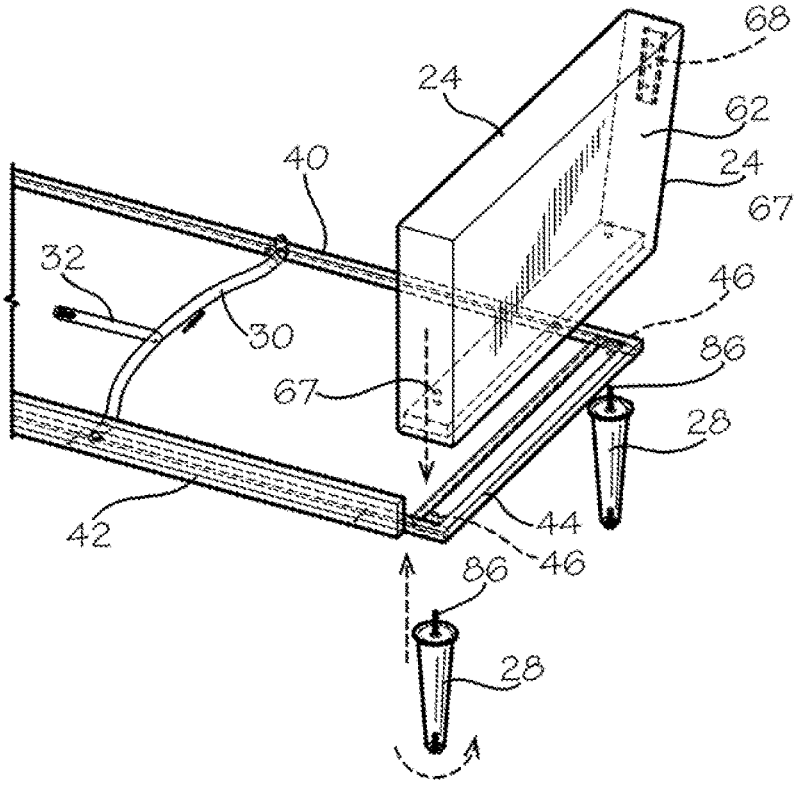
FIG. 2 illustrates in detailed perspective view an end portion of the seating apparatus and a side arm assembly and legs exploded away.

With continuing reference to FIG. 1, the base frame 22 includes a pair of opposing rails 40 that are spaced-apart to define an overall depth DI of the seating apparatus 20. As best illustrated in FIG. 2, a front plate 42 attaches to the rail 40. A pair of transverse members 44 attach at opposing ends to the rails 40. The transverse members 44 each have a pair of openings 46 near the opposing ends.

An inward face of the rail 40 includes a first opening 48 and a second spaced-apart opening 50, which openings align with the opening 48, 50 in the opposing rail. The openings 48 receive respective distal ends of the stretcher 30. In the illustrated embodiment, the stretcher rotates axially about a longitudinal axis from a first position with the leg 32 in a plane defined by the base frame 22 to a second position with the leg 32 extending downwardly to a floor for supporting the seating apparatus 20. In the second position, the plate 33 aligns with the rail 40 so that the opening 35 aligns with the opening 50. A threaded fastener 52 extends through the plate 33 and engages the opening 50 to secure the stretcher 30 to the base fame 22. In an alternate embodiment, the stretchers 30 are separate members that fasten with bolts and nuts to the rails 40.

The seat arm assemblies 24 include opposing front upright 60 and back upright 62 connected by a legrail 64 and armrail 66. The legrail 64 includes a pair of spaced thread devices 67 in alignment with the openings 46 in the transverse member 44. The threaded devices 67 may be a threaded nut, a threaded opening, or other securing member. A connecting bracket 68 attaches to the back upright 62.

The back assembly 26 includes a header rail 70 and an opposing seat rail 72 connected by opposing end members 75, 76. The illustrated embodiment includes a back plate 78. A pair of connecting members 80 attach in spaced relation to the back plate 78. The connecting members 80 are spaced to matingly engage a respective connecting bracket 68.

Figure 3:
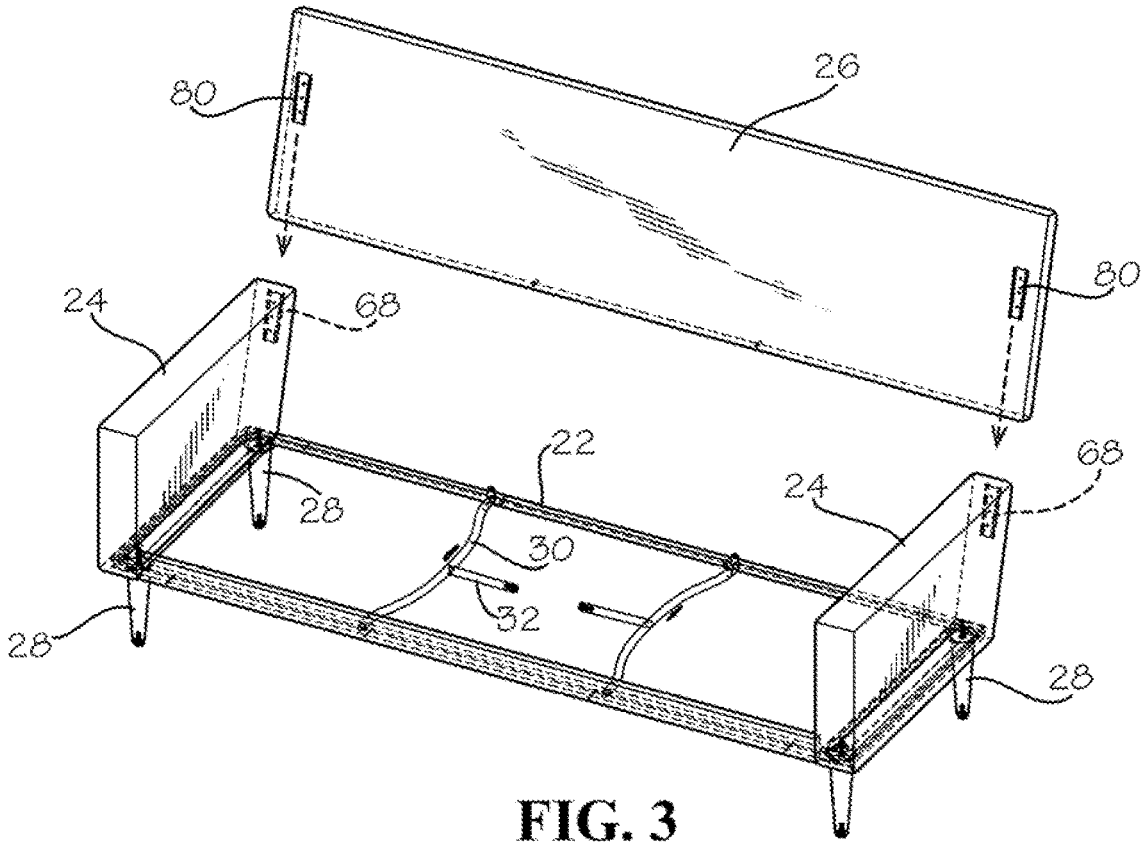
FIG. 3 illustrates in perspective view the back assembly exploded from the assembled base frame and side arm assemblies for attaching the back assembly with the mating connector members for engaging the connector brackets.

FIG. 3 illustrates the seating apparatus 20 with the pair of side arm assemblies 24 attached to the base frame 22 by the legs 28 and the back assembly 26 exploded away positioned for attaching to the pair of side arm assemblies. The stretcher 30 is positioned before rotation for extending the leg 32 downwardly from the first position to the second position contacting the floor.

As may be appreciated, the side arm assemblies 24 and the seat back assembly 26 are preferably covered with a fabric 82 for ornamental appearance and comfort in the use of the seating apparatus 20. The assembled seating apparatus 20 defines an open cavity generally 85. The upper surfaces of the opposing rails 40 provide a ledge or shelf. A spring foundation 120 illustrated in FIG. 6 has a frame 124 that may be received on the rails 40 to provide a support for seat cushions for the seating apparatus. It is to be appreciated that the length of the seat back assembly 26 may be selected to provide the seating apparatus 20 as a chair, a small sofa or chaise, an elongate sofa, or a sectional sofa (such as an L-shaped seating apparatus). The side arm assemblies 24 and the seat back assembly 26 may include foam cushion members and a fabric covering (not illustrated) for cushioned seating and use of the seating assembly and for ornamental purposes.

FIG. 2 illustrates in detailed perspective view an end portion of the seating apparatus 20 and one of the side arm assemblies 24 and two legs 28 exploded away. The side arm assembly 24 seats on the transverse member 44 so that the threaded devices 67 align with the openings 46. The leg 38 includes a threaded member 86 extending longitudinally. The threaded member 86 passes through the opening 46 and engages the threaded device 67 to secure the leg 38 to the base frame 22 while also securing the legrail 64 to the transverse member 44.

During assembly, one of the side arm assemblies 24 is placed on the base frame 28 with the legrail 64 aligned with the transverse member 44 and the openings 46 aligned with the threaded device 66. The threaded member 86 of the legs 28 pass through a respective opening 46 and threadably secures in the threaded device 66, for securely attaching the side arm assembly 24 to the base frame 22. This is repeated for the other side arm assembly 24 at the opposing end of the base frame 22.

FIG. 3 illustrates in detailed perspective view the seat back assembly 26 exploded from the pair of side arm assemblies 24 to illustrate the mating connector bracket 68 and the connector member 80 that matingly engage for attaching the back assembly 26 to the side arm assemblies 24. As discussed below, the connector bracket 68 and the connector member 80 are U-shaped channels that slidingly engage. The connector brackets 68 slidingly receive the connecting members 80 for seating the back assembly so that a bottom edge is proximate the back rail 40.

FIG. 3 illustrates in perspective view the base frame 22 in a shipping configuration with the pair of stretcher members 30 between the opposing rails 40 and the support legs 32 disposed in a plane defined by the base frame. The rails 40 in the illustrated embodiment are metal tubes and the transverse members 44 are open channels. The stretchers 30 may rotate to position the legs 32 downwardly. This brings the plate 33 into alignment with the rail 40 so that the opening 35 aligns with opening 50. The fastener 52 threadably engages the opening 50 (or nut attached thereat) to secure the stretcher 30 in the second position for use of the seating apparatus 20.

FIG. 3 illustrates in perspective view the assembled seating apparatus 20 with the stretchers 30 in the first position prior to moving to the second position. As illustrated in detailed view in FIG. 4, the stretcher 30 rotates to move the leg 32 from a horizontal position within the plane of the base frame 22 to a vertical position for bearing against a floor for use of the seating apparatus for seating. As discussed above, this brings the plate 33 into alignment with the rail 40. The opening 35 aligns with the opening 50 in the rail 40. The threaded bolt or fastener 52 then secures the plate 33 to the rail to fix the stretcher 30 securely in the base frame 22. The plate 33 on the opposite end is also secured to the front rail 40. Other stretchers 30 are similarly secured. The illustrated embodiment uses two stretchers 30 each with respective aligned pairs of openings 48, 50 in the rails 40. In an alternate embodiment, the stretchers 30 are separate members that attach to the rails 40, such as with nuts and bolts, or with wedge shaped opposed connecting members.

Figure 5:
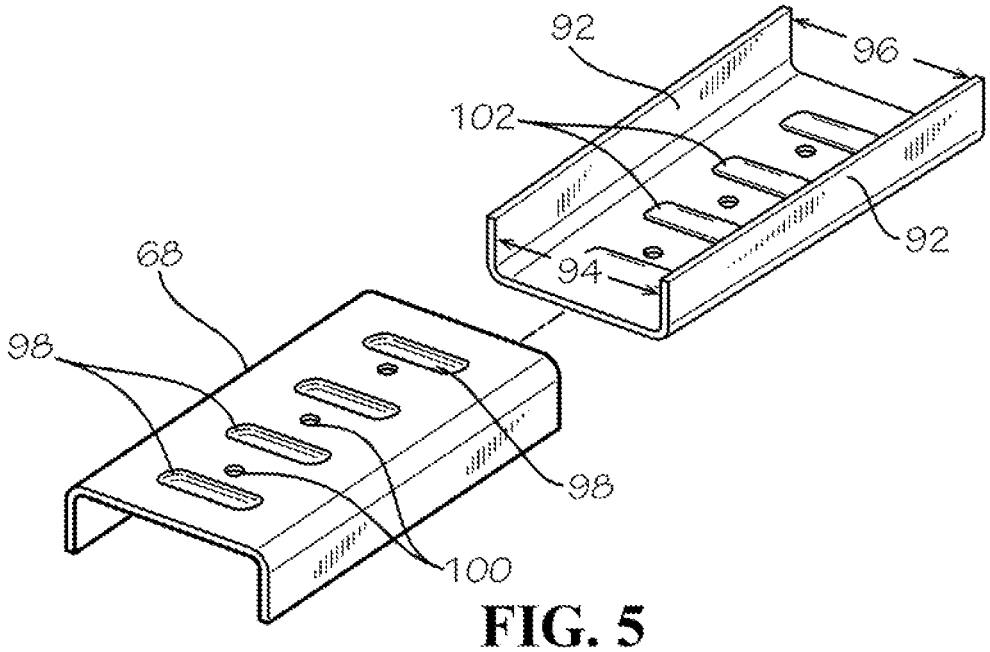
FIG. 5 illustrates in perspective view the connector bracket and the connector member that slidingly engage to secure the back assembly to the side arm assemblies of the seating apparatus.

With reference to FIG. 5, the connector bracket 68 and the mating connector member 80 in the illustrated embodiment are elongate metal channels. Each has a web 90 and opposing walls 92 to define a U-shape channel. In the illustrated embodiment, the mating connector member 80 tapers in width from a first width distance 94 to a second width distance 96. The connector bracket 68 slidingly receives the connector member 80, which side walls swedgingly engage the side walls of the connector bracket for securing the connector member to the connector bracket, and thereby securing the back assembly 26 to the side arm assemblies 24.

In the illustrated embodiment, the connector bracket 68 defines four dished recesses 98 in the web with a central elongated seat. The web 90 also defines a plurality of openings 100. These receive screws (not illustrated) for securing the connector bracket 68 to the back upright 62 of the side arm assembly 24.

The mating connector 80 defines four elongated projections 102 and the web defines a plurality of openings 104. The openings 104 receive screws for securing the mating connector 80 to the back plate 78 of the back assembly 28.

Figure 6:
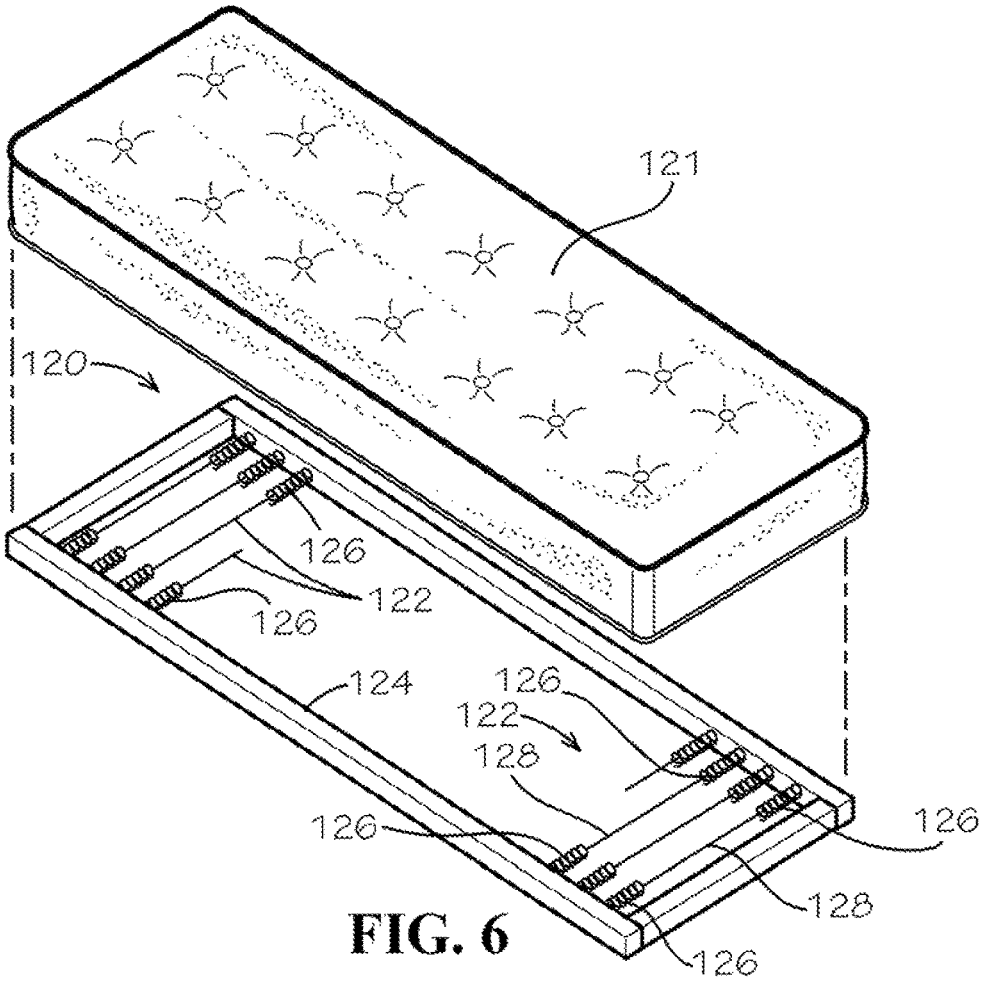
FIG. 6 illustrates in perspective view a foundation for being received on a base frame of the seating apparatus for receiving and supporting an upholstered seat cushion.

FIG. 6 illustrates in perspective view a foundation 120 that receives and supports an upholstered cushion 121. The foundation 120 has a plurality of spring tensioned supports 122 within a frame 124. The frame 124 sits on the rails 40 of the base frame 22 of the sofa. The supports 122 include opposing springs 126 that attach to the rails of the frame 124 with a support member 128 extending between the springs. After assembly of the sofa 20, the foundation 120 is placed on the rails 40, and then receives, and supports, the upholstered cushion 121.

Alternate embodiments use webbing, elongated straps, or other seat suspensions conventional in the trade attached to a frame member, or alternatively secured to the rails 40, for supporting one or more seating cushions. The seating cushion 128 is illustrated as an elongate cushion, but alternatively, the cushion may be single, double or triple format (i.e., sized for spaced seating by one, two, or three persons).

Figure 7:
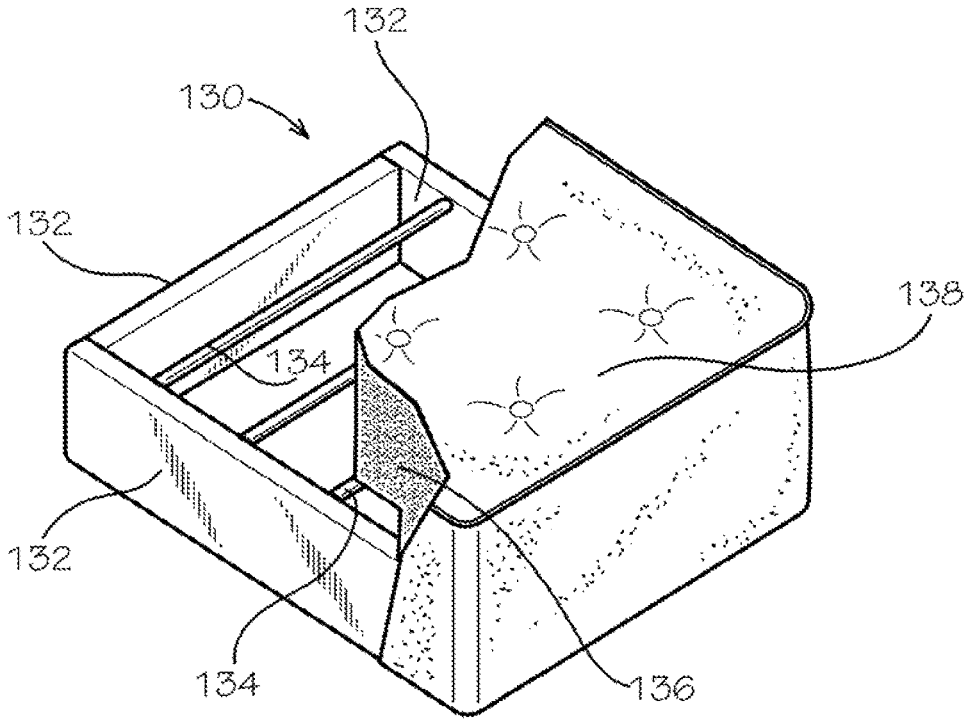
FIG. 7 illustrates in cut-away perspective view an alternate embodiment of a seat cushion foundation for being received on a base frame of the seating apparatus.

FIG. 7 illustrates in cut-away perspective view a foundation 130 having support members 132 and cross-supports 134. A seating cushion 136 sits on the supports 134, and is enclosed with a fabric 138. The base frame 22 of the sofa receives a plurality of the foundations 130 which seat on the opposing rails 40 of the base frame 22. The width and length of the foundation 130 is sized for seating on the base frame 22. For example, an elongated sofa for multiple seating positions may have multiple foundations 130. The support members 132 may be metal rods, tensioned rods, webbing, straps, or other suspension devices conventional in the trade.

With reference to FIG. 1 the components for the seating apparatus 20 are unpacked from the separate packages, for example, package (a) containing the base frame 22, package (b) containing the pair of side arm assemblies 24, and package (c) containing the back assembly 26. The legs 28 may be packaged with the side arm assemblies 24. The seating cushion 121 or 130 may be packaged with the base frame, for example, or separate.

The seating apparatus 20 assembles by positioning one of the side arm assemblies 24 in alignment with the side edge of the base frame 22 so that the threaded seats 67 in the bottom of the side arm assembly aligns with the respective opening 46. The threaded member 86 of one of the legs 28 extends through the opening 46 and threadably engages the seat 67 tightly. The other leg 28 similarly engages the other seat 67 to secure the side arm assembly to the base frame. The second side assembly 24 similarly attaches to the opposing end of the base frame 22 with the legs 28.

In an embodiment having one or more stretchers 30, the stretcher rotates axially about a longitudinal axis from the first position with the leg 32 in the plane defined by the base frame 22 to the second position with the leg 32 extending downwardly to the floor for supporting the seating apparatus 20 intermediate the opposing ends of base frame 22. In the second position, the plate 33 aligns with the rail 40 so that the opening 35 aligns with the opening 50. The threaded fastener 52 extends through the plate 33 and engages the opening 50 to secure the stretcher 30 to the base fame 22. In an alternate embodiment, the stretchers 30 are separate members that fasten with bolts and nuts to the rails 40.

The back assembly 26 attaches to the partially assembled seating apparatus 20. In the illustrated embodiment, this is accomplished by angling the back assembly downwardly towards the base frame 22 with the connecting members 80 on the front side aligned with the respective connecting bracket 68 on the back edge of the seat assemblies 24. The connecting members 80 slidingly engage the connecting brackets 68 to secure the seat back assembly in angled relation to the base frame 22. The back assembly is pushed downwardly to position a bottom edge in contact with the back support rail 44. A fastener may gainfully be used to secure the bottom edge to the back support rail 44.

The seating cushion 121 (or 130) positions on the base frame 22 supported by the stringers 30 or the support members 122 in such embodiment.

The forgoing has disclosed the furniture apparatus with seating components shippable in packaging by common carrier to a customer for readily assembling of the furniture apparatus for use as a seating assembly in various exemplary embodiments with wording and drawings of illustration and not of limitation. Variations and changes may be made by those of ordinary skill in view of the teachings of the present disclosure without departing from the scope and spirit of the invention as recited in the appended claims which extend to functionally equivalent structures, methods and components.

What is claimed is:

1. A seating apparatus comprising:

a base frame having a pair of opposing spaced-apart longitudinal rails and a pair of opposing transverse members attached at respective ends in spaced-apart relation to the pair of rails;

at least one elongated stretcher extending between the pair of rails intermediate the transverse members and a first leg extending from the stretcher medial the opposing ends of the stretcher, wherein the stretcher rotates about a longitudinal axis from a first position to a second position, the first position disposing the first leg in a plane defined by the base frame for shipping and the second position disposing the first leg extending normally for supportingly contacting a surface for use of the seating apparatus;

a pair of side arm assemblies, each having a first connector attached to a back upright of the side arm assembly and a pair of threaded seats in spaced relation in a bottom support of the side arm assembly;

a back assembly having a pair of second connectors spaced-apart for mating engagement with the first connectors of the pair of side arm assemblies for connecting the back assembly to the side arm assemblies, and a plurality of second legs each having a threaded member extending longitudinally for extending thorough a respective opening in the transverse member of the base frame and threadingly engaging a respective seat in a respective one of the side arm assemblies for securing the side arm assembly to the base frame.

2. The seating apparatus as recited in claim 1, further comprising means for securing the stretcher in the second position.

3. The seating apparatus as recited in claim 2, wherein means for securing comprises:

a pair of plates extending from the respective opposing ends of the stretcher, said plates having an opening; and the rail having a threaded recess, wherein the opening being aligned with the recess receives a threaded member through and engages the recess to secure the plate to the rail.

4. The seating apparatus as recited in claim 1, wherein the leg extending from the stretcher is movable longitudinally between a recessed position and an extended position for bearing on the surface.

5. The seating apparatus as recited in claim 1, wherein the first connector is an elongate U-shaped bracket and the second connector is an elongate U-shaped connector member that slidingly matingly engage together.

6. The seating apparatus as recited in claim 5, wherein second connector tapers in width from a first width distance to a second width distance for swedgingly engaging the first connector, whereby the back assembly securely engages the side arm assemblies.

7. A method of assembling a seating apparatus from components packaged for common carrier delivery, comprising the steps of:

(a) positioning a side arm assembly in alignment with a base frame, the side assembly having a first connector attached to a back upright of the side arm assembly and a pair of threaded seats in spaced relation in a bottom support of the side arm assembly, the base frame having a pair of opposing spaced-apart longitudinal rails and a pair of opposing transverse members attached at respective ends in spaced-apart relation to the pair of rails, the opposing transverse members each defining a pair of spaced openings for alignment with the threaded seats in a respective side arm assembly and at least one elongated stretcher extending between the pair of rails intermediate the transverse members;

(b) securing the side arm assembly to the base frame with a respective second leg having a threaded member extending longitudinally therefrom for extending thorough a respective opening in the transverse member of the base frame and threadingly engaging a respective seat in a respective one of the side arm assemblies;

(c) repeating steps (a) and (b) for a second side arm assembly on an opposing end of the base frame;

(d) positioning a first leg extending from the stretcher to supportingly contact a surface for use of the seating apparatus; and (e) positioning a back assembly in secured relation to the side arm assemblies, the back assembly having a pair of second connectors spaced-apart for mating engagement with the first connectors of the pair of side arm assemblies.

8. The method as recited in claim 7, wherein the stretcher rotates about a longitudinal axis from a first position to a second position, the first position disposing a leg extending from the stretcher in a plane defined by the base frame for shipping and the second position disposing the leg extending normally for supportingly contacting a surface for use of the seating apparatus.

9. The method as recited in claim 8, further comprising the step of securing the stretcher in the second position.

10. The method as recited in claim 9, wherein securing comprises connecting a plate extending from an end of the stretcher to the rail.

11. A seating apparatus comprising:

a base frame having a pair of opposing spaced-apart longitudinal rails and a pair of opposing transverse members attached at respective ends in spaced-apart relation to the pair of rails;

at least one elongated stretcher extending between the pair of rails intermediate the transverse members and at least one first leg extending from the stretcher, wherein the stretcher rotates about a longitudinal axis from a first position to a second position, the first position disposing the at least one first leg in a plane defined by the base frame for shipping and the second position disposing the at least one first leg extending normally for supportingly contacting a surface for use of the seating apparatus;

a pair of side arm assemblies each for connecting to the base frame at a respective one of the opposing ends;

a back assembly for connecting to the side arm assemblies; and a plurality of second legs each for depending from the base frame for supportingly contacting a surface for use of the seating apparatus.

12. The seating assembly as recited in claim 11, wherein each side arm assembly further comprises a first connector attached to a back upright of the side arm assembly; and wherein the back assembly further comprises a pair of second connectors spaced-apart for mating engagement with the first connectors of the pair of side arm assemblies for connecting the back assembly to the side arm assemblies.

13. The seating assembly as recited in claim 12, wherein each side arm assembly further comprises a bottom support and a pair of threaded seats in spaced relation in the bottom support;

said the transverse members of the base frame assembly each having a pair of openings for aligning with the pair of threaded seats in the bottom support of a respective one of the side arm assemblies; and wherein said second legs each have a threaded member extending longitudinally from an end for extending through a respective opening in the transverse member of the base frame and engaging the threaded seat in a respective one of the side arm assemblies for securing the side arm assembly to the base frame.

14. The seating apparatus as recited in claim 11, further comprising means for securing the stretcher in the second position.

15. The seating apparatus as recited in claim 14, wherein means for securing comprises:

a pair of plates extending from the respective opposing ends of the stretcher, said plates having an opening; and the rails of the base frame each having a threaded recess, wherein the opening being aligned with the recess receives a threaded member through and engages the recess to secure the plate to the rail.

16. The seating apparatus as recited in claim 11, wherein the at least one first leg extending from the stretcher is movable longitudinally between a recessed position and an extended position for bearing on the surface.

17. The seating apparatus as recited in claim 11, wherein the first connector is an elongate U-shaped bracket and the second connector is an elongate U-shaped connector member that slidingly matingly engage together.

18. The seating apparatus as recited in claim 17, wherein second connector tapers in width from a first width distance to a second width distance for swedgingly engaging the first connector, whereby the back assembly securely engages the side arm assemblies.

19. A method of assembling a seating apparatus from components packaged for common carrier delivery, comprising the steps of:

(a) securing a first side arm assembly of a pair of side arm assemblies in alignment with a base frame, the base frame having a pair of opposing spaced-apart longitudinal rails and a pair of opposing transverse members attached at respective ends in spaced-apart relation to the pair of rails, and at least one elongated stretcher extending between the pair of rails intermediate the transverse members;

(b) securing a second side arm assembly of the pair of side arm assemblies to an opposing end of the base frame;

(c) positioning a first leg extending from the stretcher to supportingly contact a surface for use of the seating apparatus;

(d) securing a back assembly to the side arm assemblies; and (e) attaching a plurality of second legs to the base frame for supporting the seating apparatus on the surface.

20. The method as recited in claim 19, wherein each of the pair of the side assemblies has d a pair of threaded seats in spaced relation in a bottom support of the side arm assembly;

the opposing transverse members of the base frame each defining a pair of spaced openings for alignment with the threaded seats in a respective side arm assembly; and securing the first and second side arm assembly to the base frame with a respective second leg, each second leg having a threaded member extending longitudinally therefrom for extending thorough the respective opening in the transverse member of the base frame and threadingly engaging a respective threaded seat in a respective one of the side arm assemblies.

21. The method as recited in claim 19, wherein each of the pair of side arm assemblies further comprising a first connector attached to a back upright of the side arm assembly and the back assembly having a pair of second connectors spaced-apart for mating engagement with the first connectors; and the step of securing the back assembly to the side arm assemblies comprises engaging the respective first and second aligned connectors.

* * * * *